US005784662A

United States Patent [19]

Ridgway

[11] Patent Number: 5,784,662

[45] Date of Patent: Jul. 21, 1998

[54] CARRIER FOR PHOTOGRAPHIC MATERIAL

[75] Inventor: Michael Ridgway, Aldbury, England

[73] Assignee: Eastman Kodak Company, Rochester, N.Y.

[21] Appl. No.: 669,254

[22] Filed: Jun. 21, 1996

[30] Foreign Application Priority Data

Jun. 30, 1995 [GB] United Kingdom ..... 9513409

[51] Int. Cl.[6] ..... G03D 13/08

[52] U.S. Cl. ..... 396/647

[58] Field of Search ..... 396/595, 598, 396/602, 603, 640, 642, 644, 647; 206/455

[56] References Cited

U.S. PATENT DOCUMENTS

| | | | |
|---|---|---|---|
| 2,344,710 | 3/1944 | McMurty | 396/640 |
| 3,069,002 | 12/1962 | Hart | 206/455 |
| 3,741,099 | 6/1973 | Buckley | 396/640 |
| 3,760,822 | 9/1973 | Evans | 134/99.1 |
| 4,188,107 | 2/1980 | Mitchell | 396/633 |
| 4,288,156 | 9/1981 | Savage | 396/598 |
| 4,332,455 | 6/1982 | Stettner | 427/160 |
| 4,745,442 | 5/1988 | Oshikoshi et al. | 355/28 |
| 4,856,544 | 8/1989 | McConnell | 134/95.1 |

FOREIGN PATENT DOCUMENTS

| | | |
|---|---|---|
| 367644 | 2/1932 | United Kingdom . |
| 712466 | 7/1954 | United Kingdom . |
| 1066913 | 4/1967 | United Kingdom . |

OTHER PUBLICATIONS

*The Handbook of Photographic Equipment &Techniques*, Adrian Holloway Pan Books, "Film Processing/Roll–Film Tanks", p. 161.

*Primary Examiner*—D. Rutledge
*Attorney, Agent, or Firm*—Frank Pincelli; David A. Novais

[57] ABSTRACT

During processing of a photographic material, the non-sensitive surface of the material may become contaminated by the processing solutions used. Described herein is a support or carrier (10) which prevents such contamination of the non-sensitive surface. The carrier (10) comprises a series of parallel, upright blades (12*a*, 12*b*, . . . , 12*q*) separated by spacers (14*a*, 14*b*, . . . , 14*q*). Each blade (12*a*, 12*b*, . . . , 12*q*) has an upper edge (16*a*, 16*b*, . . . , 16*q*) which, when the carrier (10) is oriented horizontally, lies in a horizontal plane. The blades (12*a*, 12*b*, . . . , 12*q*) are sufficiently thick and rigid to support a sheet of photographic material lying on them without damage, the material being slightly larger than the carrier to prevent contact between the edges of the material and the carrier thereby avoiding transfer of any processing solution on the sensitive surface of the material to the non-sensitive surface thereof.

8 Claims, 2 Drawing Sheets

CARRIER FOR PHOTOGRAPHIC MATERIAL

FIELD OF THE INVENTION

This invention relates to a carrier for photographic material.

BACKGROUND OF THE INVENTION

Many photographic materials only have one surface which requires treatment with the various liquids which are used in processing photographic materials. For example, photographic paper, of the type which is used to produce prints from negatives, has a light sensitive surface which needs to be exposed to processing liquids during development of the paper, and a reverse, or back surface, which does not have to be exposed to processing liquids. If the reverse surface does come into contact with processing liquids, that surface has to be washed and dried. If processing is being carried out in the field, supplies of water may be limited. Indeed there may not be sufficient water available for washing the reverse surface. The need for washing would be avoided if the reverse surface could be kept uncontaminated. Also, some photographic materials have special coatings, for example gelatin, on their reverse surfaces which can be damaged by water based processing liquids. Thus, when processing photographic material, it is often desirable to process the material in such a way that only the sensitive surface of the material is brought into contact with processing liquids. With the carriers used in existing types of processing apparatus it is not possible to prevent contamination of the reverse side of the material.

In one common type of photographic processor, a drum processor, the photographic paper is wrapped around a drum, which acts as a carrier. Processing liquids are then applied to the sensitive surface of the paper either by spraying them onto the paper or by rotating the drum in a reservoir containing processing liquid. Although no processing liquid is applied directly to the reverse surface of the photographic paper, in these types of processor, liquid inevitably forms a meniscus at the edge of the paper and is then drawn behind the drum and onto the reverse surface of the paper by capillary attraction.

In flat bed processors the sheet of paper to be developed is held flat on a carrier. Processing liquids are then either sprayed onto the sensitive surface of the paper, or as shown in U.S. Pat. No. 4,288,156, the carrier is immersed in a reservoir of processing liquid. U.S. Pat. No. 4,288,156 describes a flat bed type carrier for a sheet of photographic paper which includes a smooth plate for receiving a piece of wet paper. Surface tension between the wet paper and the smooth surface is used to help retain the paper on the carrier. The carrier is then immersed in a reservoir.

The above are typical of known types of processing apparatus where wetting of the reverse surface of the paper is regarded as being so inevitable, that it is commonly utilised to assist in holding the paper against the carrier.

Problem to be Solved by the Invention

This invention seeks to solve the problem of contamination of the reverse surface of photographic paper by providing a support or carrier for photographic material which will prevent liquids contaminating the reverse surface of the paper.

SUMMARY OF THE INVENTION

According to one aspect of the present invention, there is provided a carrier for supporting a sheet of photographic material during processing of the same, the material having a sensitive surface requiring processing and a reverse surface, the carrier comprising a carrier surface arranged to support the sheet of photographic material, characterized in that:

at least the edges of the carrier surface comprise thin blades defining upper edges which are arranged to support at least a portion of the reverse surface of the sheet during processing.

In the case of a flat bed type of carrier, the carrier surface is generally planar.

In a preferred embodiment the carrier includes a central part which defines a planar surface and the blades are disposed around the edges of that surface.

Typically, the central part comprises a generally rectangular bed and the blades are spaced from and extend continuously around the perimeter of the bed.

Conveniently, suction means are provided which are arranged to assist in retaining a sheet of material against the bed and high pressure means are provided for blowing gas into the space between the blades and the perimeter of the bed.

Typically, the suction means include a suction pump. Conveniently, the high pressure gas is provided by exhaust gases from the suction pump.

In one embodiment the carrier surface is defined by the upper edges of a series of substantially parallel blades separated by spacers.

In another embodiment the carrier includes a series of substantially parallel cylindrical blades, the outer edges of which lie in the same cylindrical surface and define at least a part of the carrier surface.

Advantageous Effect of the Invention

The present provides a carrier with which it is possible to confine contact between the carrier and the paper to the back of the paper away from the edges of the paper. Thus, wetting or contamination of the reverse surface of the photographic material is avoided. The advantages in this are improvements in the efficiency of the process by eliminating the need to wash and dry the reverse surface of the photographic material. This also saves water. Also, damage to any water sensitive coatings on the reverse side of the photographic material is avoided. In contrast, with existing carriers having flat surfaces, processing liquids, such as developer, are drawn under a sheet of paper being developed by capillary attraction and contaminate the reverse side of the paper. Further, unless the carrier were washed after the sheet of paper had been developed, the developer would remain on the carrier to stain the edges of the next sheet of paper placed on the carrier for development. With the carrier of the present invention, the contact between the blades and the photographic material is so small that, if any processing liquids, or any other liquids, were present on the carrier, there is a reduction in the amount of that liquid which might contaminate the paper.

Advantageously, sensitivity of the carrier surface to trapped detritus is reduced. First, there is much less surface on which detritus may become trapped. Secondly, detritus trapped behind between the carrier of the present invention and a sheet of paper will not form a channel for the transmission of liquids as is the case with existing carriers having flat surfaces.

Preferred embodiments of the invention which are listed above also present advantageous effects. In particular, the use of a solid central bed, with the blades disposed around the perimeter of the bed, improves the transfer of heat from the carrier to processing fluids. Temperature control during processing is important as it significantly affects the rate of processing, in particular the rate of development of any image recorded on the photographic material. If the carrier is maintained at the correct temperature, cold processing fluids can be warmed up by thermal transfer of heat from the bed to within half a degree of the optimum temperature within a tenth of a second. Also the mechanical strength of the bed is improved. The blades disposed around the perimeter reduce the chances of contamination of the reverse surface of the material.

If the material is held against the central part of the bed by suction, then blowing high pressure gas into the gap between the perimeter and the blades reduces the chances of processing liquids being sucked between the blade and the reverse surface of the material.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
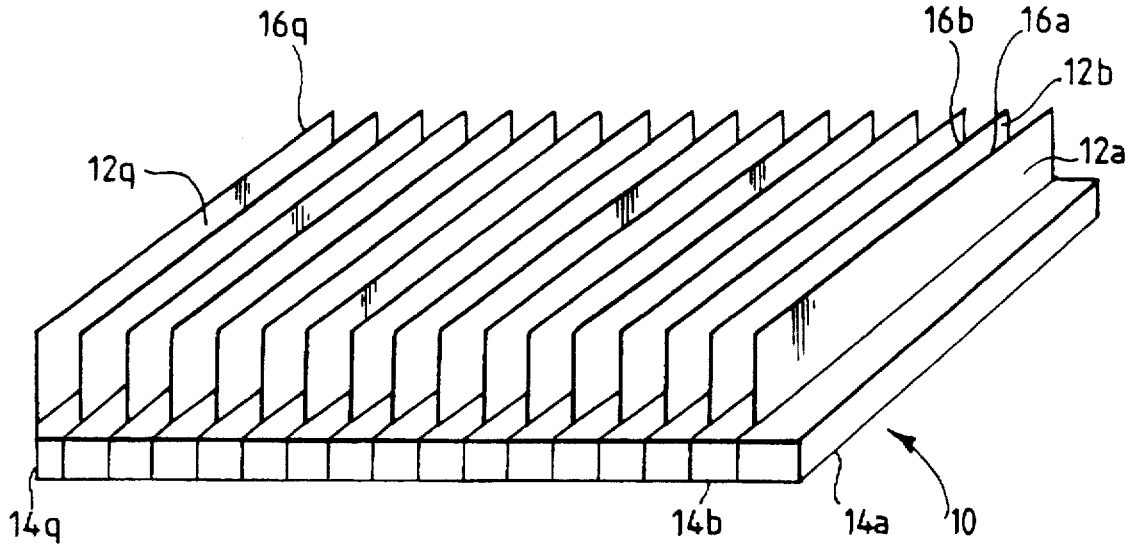
FIG. 1 is a schematic illustration of a carrier constructed in accordance with a first embodiment of the present invention.

Referring to the drawings, FIG. 1 shows a carrier 10 for supporting a sheet of photographic material, such as photographic paper, not shown. The carrier comprises a series of parallel, upright blades 12*a*, 12*b*, . . . 12*q*, separated by spacers 14*a*, 14*b*, . . . 14*q*. Each blade has an upper edge 16*a*, 16*b*. . . 16*q*. When the carrier is oriented horizontally, the upper edges 16*a*, 16*b*, . . . 16*q*, lie in a horizontal plane. The blades 12*a*, 12*b*, . . . 12*q*, are as thin as possible while being sufficiently rigid and thick to support a sheet of paper resting on them without cutting or damaging the paper. The distance between the blades, which depends on the thickness of the spacers 14, should not be so great as to cause the paper to sag in the gaps between the blades. Ideally, the sheet of paper is slightly larger than the bed 10. In this way there is no contact between the edges of the paper and the carrier. Thus, the likelihood of any processing liquids on the sensitive surface of the paper being transferred to the reverse surface of the paper is reduced.

EXAMPLE 1

A test flat bed carrier for the purposes of illustrating the invention was made by sandwiching microscopic cover glasses(acting as blades) with aluminum spacers. The cover glasses were 22 mm by 22 mm; the spacers were 22 mm by 10 mm by 3 mm. The flat bed was tested by placing it on the back of a horizontal paper sample, face down on a support. Water colored with potassium permanganate was placed against the outer facing side of one, 12*a*, of the two outermost cover slips, where it pressed onto the paper. Virtually no water penetrated under the cover slip into the gap between cover slips 12*a* and 12*b*. Control beds comprising flat sheets of various materials ranging from PVC to PTFE, polythene and wax all drew considerable amounts of water under the bed. The above example is purely to illustrate the invention and is not intended to suggest practical materials for making a carrier embodying the invention.

Figure 2:
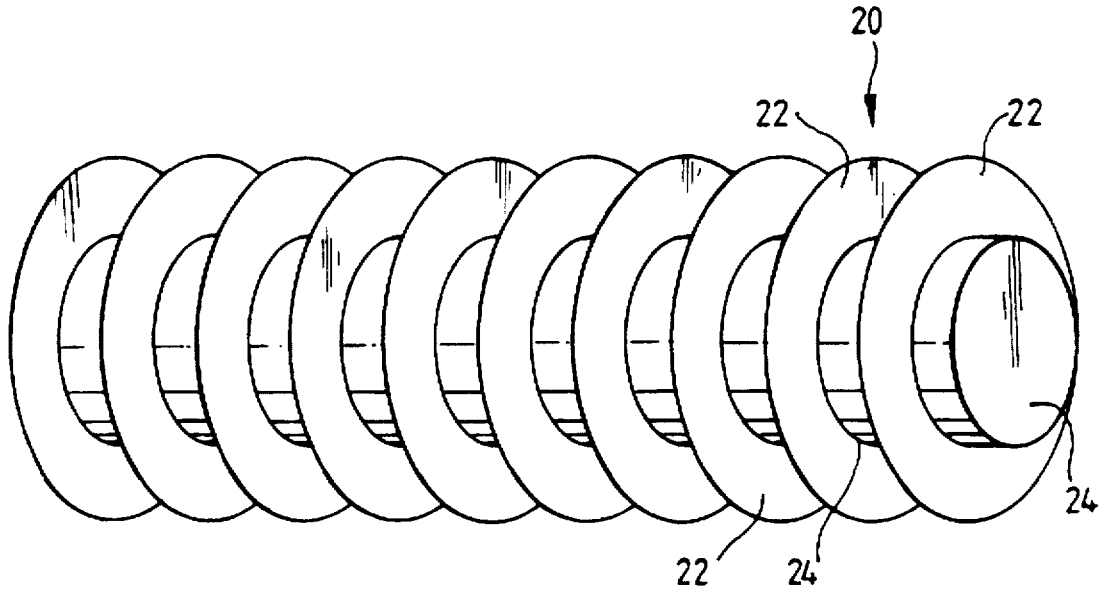
FIG. 2 is a schematic illustration of a roller carrier constructed in accordance with a second embodiment of the present invention.
Figure 3:
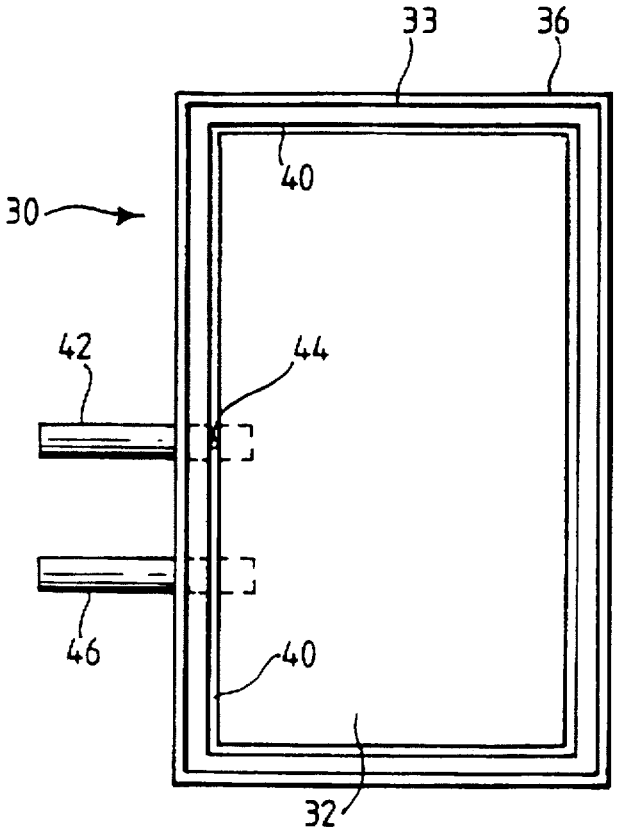
FIG. 3 is a schematic illustration, shown in plan view, of a flat bed type carrier constructed in accordance with a third embodiment of the present invention.

FIG. 2 shows a roller type carrier 20 which is formed from a series of thin circular blades, or discs 22 separated by cylindrical spacers 24. The edges 24 of the discs lie in the same cylindrical surface. Carrier 20 can be used instead of a drum in drum type processors of the type where photographic material is wrapped around the outside of a drum for processing.

In the case of the carrier shown in FIG. 1, the paper can be held against the carrier by blowing low pressure high volume air onto the paper by means of, for example, a centrifugal fan, not shown. The air will also act as an aid to drying the paper or stirring the surface of any processing liquids on the surface of the sheet, thus improving agitation and improving the rate of development and evenness of development of the paper.

In the case of the roller type carrier 20 described above, paper may be held against the roller by suction means, not illustrated. Processing liquids could be sprayed onto the paper.

If only one size of paper is to be developed on a particular carrier the central section of the carrier may be a simple plane surface since this improves temperature control. Photographic processing is temperature sensitive. With modern photographic methods and processing chemicals each processing step can be carried out in as little as 5 to 10 s. However at those development speeds the temperature of the paper and the processing liquids must be accurate to approximately 0.25° to 0.50°. If the central part of the carrier surface is a simple plane surface this improves temperature control because the carrier, which is maintained at the correct processing temperature, has a much greater area in contact with the paper being processed than the first embodiment of the carrier. Typically, cold processing fluids can warm up very quickly to within half a degree of the correct temperature, at which the carrier is maintained, within a tenth of a second. This allows processing liquids to be stored at room temperature, or below which reduces energy requirements and improves the shelf life of the processing liquids. It is also much easier to warm up a resistive plate to an accurate temperature than a bulk liquid. The blades which prevent liquids contaminating the reverse surface of the paper are in this embodiment, disposed around the outer edge of the central part. A solid central surface also improves the mechanical strength of the carrier.

Figure 5:
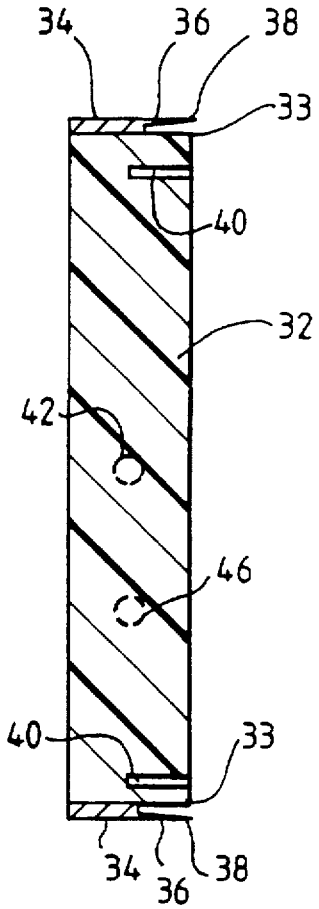
FIG. 5 is a schematic side elevation of the flat bed carrier of FIG. 3.
Figure 4:
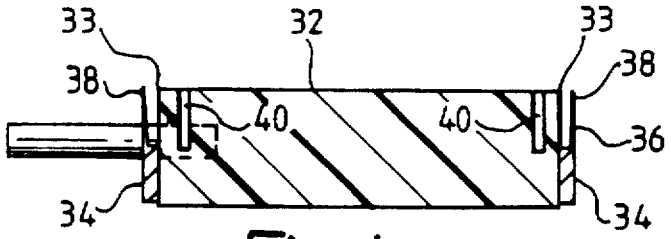
FIG. 4 is a schematic end elevation of the flat bed carrier of FIG. 3.

FIGS. 3 to 6 illustrate a flat bed type carrier 30 which embodies the features discussed above. The flat bed carrier 30 is slightly smaller in area than the sheet of paper which it has to support. It comprises a rectangular bed 32 of PVC whose perimeter or edge 33 measures 290 mm by 202 mm. A series of 2.5 mm thick spacers 34 support blades at 36 a distance of 2.5 mm from perimeter 33 of the bed. The blades extend continuously around the perimeter of the bed. As can be seen in FIGS. 4 and 5, the upper edges 38 of the blades lie in the same horizontal plane as the surface of the bed 32.

A 3 mm thick channel 40 runs around the inside of the perimeter 33 of the bed at a distance of 5 mm from the perimeter. The channel 40 is connected at 44 to a low pressure tube 42 which itself is connected to a suction pump. A high pressure tube 46, for providing high pressure air, is connected to the gap between the edge 33 of the bed and the blades 36 and spacers 34. Conveniently, the high pressure air may be supplied from the outlet from the suction pump.

Figure 6:
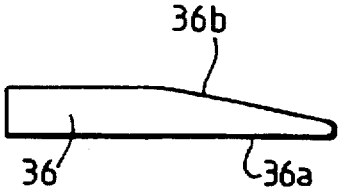
FIG. 6 shows a detailed view of a blade which forms part of the carrier shown in FIGS. 3 to 5.

FIG. 6 illustrates the blades 36 in cross-section. One side 36*a* which faces away from the bed 32 is planar: the opposite side 36*b* which faces towards the bed tapers towards side 36*a*. The tip of the blade is 50 μm (0.002 in) thick.

In use, a sheet of photographic paper is placed on the bed and the suction pump is operated to retain the sheet in place on the bed. The exhaust from the suction pump provides high pressure air. This is blown out into the gap between the blades 36 and the edge 33 of the bed and prevents any pressure drop across the blades that would occur if only suction of the paper onto the bed were provided. If the pressure across the blades were allowed to drop, that pressure might draw processing fluid between the edges of the blades and the reverse side of the paper and contaminate the reverse side of the paper. Supplying the high pressure air from the exhaust of the suction pump provides a degree of self-regulation in the system.

The dimensions given in the various examples of carriers described above are not critical, and the skilled man will appreciate that those dimensions can be altered to suit different types and sizes of photographic material being processed.

Although the foregoing describes the use of a carriers for photographic paper, a variety of photographic materials could be supported on the carrier for processing.

Further, although the carriers described above are principally intended for use with photographic materials which have only one light sensitive surface, they could be used to develop double sided sheet materials, particularly where it is desired to develop one side of the material in a different manner from the other for example to give different contrast to the different sides. In this context the term reverse surface should not be construed as limited to a non light sensitive surface.

I claim:

1. A carrier for supporting a sheet of photographic material during processing of the same, the material having a sensitive surface requiring processing and a reverse surface, the carrier comprising a carrier surface arranged to support the sheet of photographic material, said carrier surface comprising:

thin blades, each of said thin blades defining an upper edge, said upper edge is arranged to define said carrier surface for supporting at least a portion of the reverse surface of the sheet during processing.

2. A carrier according to claim 1, characterized in that the carrier surface defined by said upper edge is generally planar.

3. A carrier according to claim 1, characterized in that said carrier includes a central part which defines a simple plane surface and in that the blades are disposed around the edges of said surface.

4. A carrier according to claim 3, characterized in that the central part comprises a generally rectangular bed and in that the blades are spaced from and extend substantially continuously around the perimeter of the bed.

5. A carrier according to claim 4, characterized in that suction means are provided which are arranged to assist in retaining a sheet of material against the bed and in that high pressure means are provided for blowing gas into the space between the blades and the perimeter of the bed.

6. A carrier according to claim 4, characterized in that the suction means include a suction pump and the high pressure means for blowing gas comprise the exhaust from the suction pump.

7. A carrier according to claim 1, characterized in that said thin blades comprise a series of substantially parallel cylindrical blades, the upper edges of which lie in the same cylindrical surface.

8. A carrier for supporting a sheet of photographic material during processing of the same, the material having a sensitive surface requiring processing and a reverse surface, the carrier comprising a carrier surface arranged to support the sheet of photographic material, said carrier surface comprising:

thin blades, each of said thin blades defining an upper edge, said upper edge is arranged to define said carrier surface for supporting at least a portion of the reverse surface of the sheet during processing, wherein the carrier surface is defined by the upper edges of a series of substantially parallel blades separated by spacers.

* * * * *